United States Patent [19]

Okoma

[11] Patent Number: 4,776,183

[45] Date of Patent: Oct. 11, 1988

[54] LATERAL TYPE ACCUMULATOR

[75] Inventor: Kaoru Okoma, Fujinomiya, Japan

[73] Assignee: Kabushiki Kaisha Toshiba, Kawasaki, Japan

[21] Appl. No.: 139,599

[22] Filed: Dec. 30, 1987

[30] Foreign Application Priority Data

Feb. 6, 1987 [JP] Japan ..... 62-16355[U]

[51] Int. Cl.[4] ..... F25B 43/00

[52] U.S. Cl. ..... 62/503; 55/308; 55/319; 55/462

[58] Field of Search ..... 62/503, 512; 55/308, 55/319, 462–465

[56] References Cited

U.S. PATENT DOCUMENTS

| | | | |
|---|---|---|---|
| 1,024,688 | 4/1912 | Lewis | 55/463 X |
| 2,121,253 | 6/1938 | McGuffey | 62/503 X |
| 3,163,998 | 1/1965 | Wile et al. | 62/503 X |
| 3,370,440 | 2/1968 | Kellie | 62/503 |
| 3,553,974 | 1/1971 | Osborne | 62/512 X |
| 3,792,594 | 2/1974 | Kramer | 62/503 |
| 4,305,548 | 12/1981 | Miner et al. | 55/319 X |
| 4,494,692 | 1/1985 | Dobias | 55/462 X |
| 4,607,503 | 8/1986 | Fry | 62/503 |
| 4,683,726 | 8/1987 | Barron | 62/503 |

FOREIGN PATENT DOCUMENTS

| | | | |
|---|---|---|---|
| 57-152584 | 9/1982 | Japan . | |
| 61-4184 | 1/1986 | Japan . | |
| 699568 | 11/1953 | United Kingdom | 62/503 |

*Primary Examiner*—William E. Tapolcai

*Attorney, Agent, or Firm*—Cushman, Darby & Cushman

[57] ABSTRACT

A lateral type accumulator includes a hermetic container which is divided into an intake cell, a discharge cell and a storage chamber between the cells in a horizontal direction by an intake side plate and a discharge side plate, and intake pipe connected to the intake cell, a discharge pipe connected to the discharge cell, and a gas fluid passage from the intake cell to the discharge cell through the intake side and the discharge side plates. The mixture of a lubricating oil and a refrigerant including a gas element and a liquid element is drawn into the storage chamber through the intake pipe and the intake cell, and the mixture is separated into the gas element and a remaining mixture in the storage chamber, hereupon the gas element is discharged from the discharge pipe through the discharge cell along the gas fluid passage. The surface level of the lubricating oil and refrigerant is maintained greater than that in the intake and the discharge cells during the operation of an refrigerating circuit.

14 Claims, 3 Drawing Sheets

LATERAL TYPE ACCUMULATOR

BACKGROUND OF THE INVENTION

1. Field of the Invention

The present invention relates, in general to accumulators which are employed with a compressor in a refrigerating circuit for separating a liquid element from a refrigerant fed to the compressor. In particular, the invention relates to an accumulator laterally arranged close to a lateral type compressor.

2. Description of the Prior Art

Generally, a refrigerant circulating through a refrigerating circuit includes a gas element and a liquid element. The gas element is periodically compressed to a prescribed pressure by a compressor, and is discharged to the refrigerating circuit. If the liquid element of the refrigerant is taken into the compressor together with the gas element, liquid compression occurs in the compressor during the compressing operation. The liquid compression causes the compressor to be dameged. This is because the liquid element of the refrigerant in the compressor cannot be compressed, and therefore, a large repulsion force occurs in the compressor during the operation.

To prevent the above-described liquid compression, an accumulator is connected to the intake side of the compressor for separating the liquid element from the refrigerant. One example of a conventional accumulator is shown in FIG. 1. A hermetic container 11 includes a pair of receptacles 13*a* and 13*b* hermetically connected to one another. An intake pipe 15 is provided on the bottom of upper receptacle 13*a*, and projects into the interior of tcontainer 11. An output pipe 17 is provided on the bottom of lower receptacle 13*b*, and projects into the interior of container 11 a prescribed length, as shown in FIG. 1. An oil return hole 18 is provided to the projected portion of pipe 17 close to tbe bottom of lower receptaole 13*b*. A screen 19 is provided between intake pipe 15 and output pipe 17 for filtering foreign substances contained in the refrigerant. Therefore, screen 19 partitions container 11 into an upper chamber 21*a* and a lower chamber 21*b*.

With the construction described above, when the mixture of a lubricating oil and refrigerant including a gas element and a liquid element flows into container 11 through intake pipe 15, the gas element of the refrigerant is separated from the mixture in container 11. The gas element of the refrigerant is discharged through output pipe 17, and the lubricating oil and the liquid element of the refrigerant are accumulated in the lower chamber 21*b* of container 11. Furthermore, the accumulated lubricating oil also is discharged through oil return hole 18 of output pipe 17 together with the accumulated liquid element of the refrigerant. Therefore, the gas element of refrigerant, the lubricating oil and the liquid element of refrigerant flow toward the compressor. At this time, the liquid element of the refrigerant fed from output pipe 17 vaporizes during the flow to the compressor.

However, since the above-described accumulator is originally manufactured for a vertical type compressor, it may not be adapted readly to a lareral type compressor. The lateral type compressor is used for reduce the installation height of the compressor. However, as shown in FIG. 2, since the accumulator is vertically attached close to the lateral type compressor 23, the upper portion of the accumulator projects upward from oompressor 23. Therefore, the height of the overall assembly of the compressor and the accumulator oannot be reduced, in spite of the use of the lateral type compressor. Furthermore, since container 11 includes substantially one common chamber, pressure fluctuation may occurs in container 11 in response to the compressing and releasing operation of the compressor. As shown in FIG. 1, since the mixture of lubricating oil and refrigerant showers on the lubricating oil and the refregerant stored in container 11, a stable liquid separation cannot be carried out.

SUMMARY OF THE INVENTION

Accordingly, it is an object of the present invention to coordinate the height of an accumulator with a lateral type compressor when the accumulator is attached to the compressor.

It is another object of the present invention to reduce the pressure fluctuation, which occurs in response to the compressing and releasing operation of a compressor, in an accumulator.

To accomplish the above objects, the accumulator in which a gas element is separated from a mixture of a lubricating oil and a refrigerant including the gas element and a liquid element includes a substantially hermetical container for maintaining a reservoier of the lubricating oil and refrigerant for supply to the circuit. The accumulator further includes a storage chamber in the container, an intake side cell and a discharge side cell on opposite sides of the storage chamber in the horizontal direction, each including a common wall with the storage chamber for separating the intake side cell and the discharge side cell from the storage chamber, and a gas fluid passage at the upper part of the storage chamber for communicating the gas element from the intake side cell to the disoharge side cell. The level of the lubricating oil and refrigerant in the storage chamber is greater than that in the intake side and discharge side cells when the refrigerating circuit operates.

The container may include an intake side receptacle and a discharge side receptacle hermetically coupled with one another. The common walls may include an intake side partition plate in the intake side receptacle and a discharge side partition plate in the discharge side receptacle for defining the storage chamber between the partition plates. Tbe common walls may further include an inner partition plate parallel to the discharge side plate substantially in the center of the discharge side receptacle.

BRIEF DESCRIPTION OF THE DRAWINGS

These and other objects and advantages of this invention will become more apparent from the following detailed description of the presently preferred embodiment of the invention, taken in conjunction with the accompanying drawings of which.

DETAILED DESCRIPTION OF THE PREFERRED EMBODIMENTS

Figure 1:
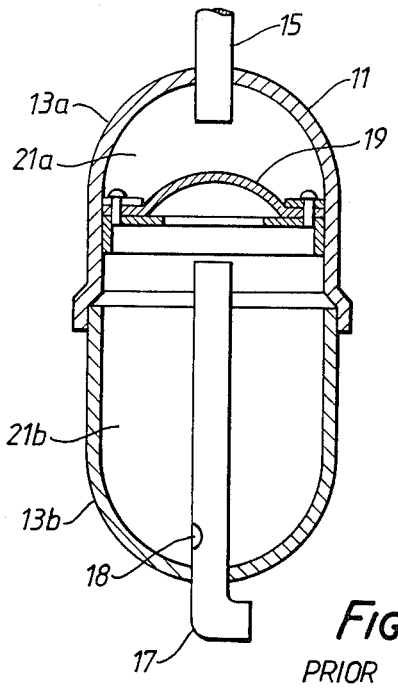
FIG. 1. PRIOR ART
FIG. 1 is a cross sectional side view illustrating one prior art accumulator.
Figure 2:
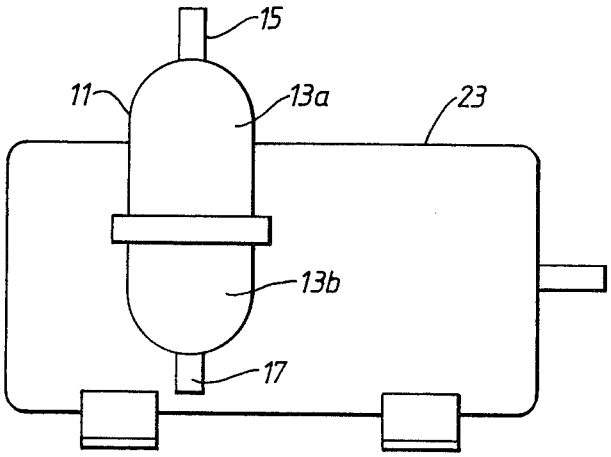
FIG. 2. PRIOR ART
FIG. 2 is a side view illustrating the prior art accumulator shown in FIG. 1 with a compressor.
Figure 3:
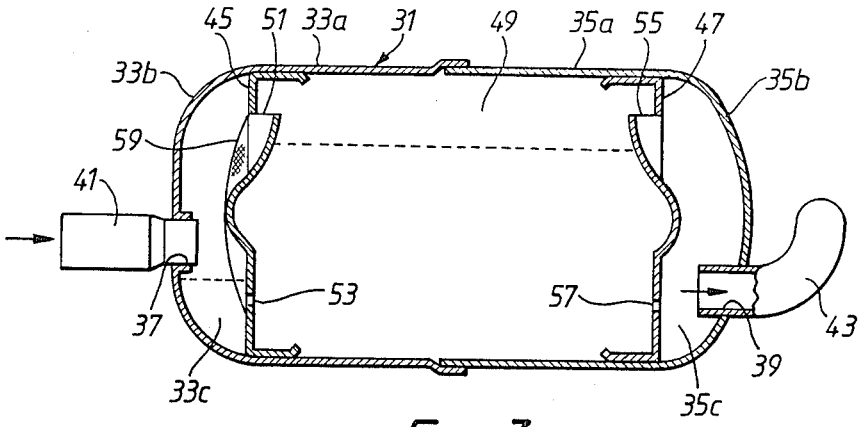
FIG. 3 is a cross sectional side view illustrating an accumulator of one embodiment of the present invention.

Preferred embodiments of the present invention will not be described in more detail with reference to the aooompanying drawings. As shown in FIG. 3, a hermetic container 31 includes a pair of cylindrical receptacles 33*a* and 35*a*, each of which has a hemispheric shaped bottom 33*b*, 35*b*. Each opening of receptacles 33*a* and 35*a* is airtightly connected with one the other.

An intake port 37 is provided on the lower portion of hemispheric bottom 33*b* of receptacle 33*a*. A discharge port 39 is provided on the lower portion of hemispheric bottom 35*b* of receptacle 35*a*. An intake pipe 41 and a discharge pipe 43 are individually inserted in corresponding ports 37 and 39 for communicating the interior of container 31.

As shown in FIG. 3, a first partition plate 45 is perpendicularly provided in receptacle 33*a* close to intake port 37. An intake side cell 33*c* is defined between hemispheric bottom 33*b* of receptacle 33*a* and first partition plate 45. A second partition plate 47 is perpendicularly provided in receptacle 35*a* close to discharge port 39. An discharge side cell 35*c* is defined between hemispheric bottom 35*b* of discharge side receptacle 35*a* and second partition plate 35*b*. A storage chamber 49 also is established between intake side cell 33*c* and discharge side cell 35*c* by first and second partition plates 45 and 47. The upper part of first partition plate 45 is cut and curved toward storage chamber 49 to form a first communicating opening 51, which faces the ceiling of storage chamber 49. An oil return hole 53 is provided on the lower portion of first partition plate 45. In the same manner, a second communicating opening 55 is provided on the upper portion of second partition plate 47, and an oil return hole 57 also is formed to the lower portion of second partition plate 47 close to discharge port 39. A screen 59 is attached to the surface of first partition plate 45 for filtering foreign substanoes oontained in the mixture of lubricating oil and refrigerant fed through intake pipe 41. Therefore, a gas fluid passage is established between intake port 37 and discharge port 39 through first and second communicating openings 51 and 55.

Figure 4:
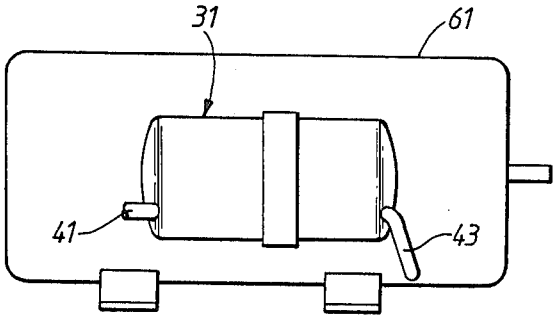
FIG. 4 is a side view illustrating the accumulator shown in FIG. 3 with a compressor.

The operation of the above-described accumulator will now be described hereafter. The accumulator is attached in parallel to a compressor 61, as shown in FIG. 4. Discharge pipe 43 is connected to the input port of compressor 61. Intake pipe 41 is conneoted to the refrigerating circuit (not shown). The refrigerant in the refrigerating circuit circulates through the accumulator and compressor 61. When compressor 61 operates, the refrigerant flows through the refrigerating circuit. The refrigerating circuit is typically provided with a plurality of heat exchangers (evaporator and condenser). Almost all the refrigerant changes to the gaseous state, but some of the refrigerant remains in the liquid state in response to a load condition during the circulation of the refrigerant.

In response to the operation of compressor 61, the mixture of lubricating oil and the refrigerant including the gas element and the liquid element is forcibly and periodically taken into accumulator (hermetic container 31) through intake pipe 41. The mixture is filtered by soreen 59, and enters into storage chamber 49 through first communicating opening 51 of first partition plate 45. At this time, the mixture guided by first partition plate 45 impinges against the ceiling of storage chamber 49. Thus, the lubricating oil and the liquid element of the refrigerant fall on the bottom of storage chamber 49 because of its big mass, and are accumulated in storage chamber 49. Only the gas element of the refrigerant flows along the ceiling of storage chamber 49, and is discharged to compressor 61 through second communicating opening 55 and discharge pipe 43. A small amount of the liquid mixture of the lubricating oil and the liquid element of the refrigerant accumulated in storage chamber 49 also is discarged to compressor 61 through oil return hole 57 of second partition plate 47 and discharge pipe 43 together with the gas element of the refrigerant. At this time, oil return hole 57 regulates the amount of the liquid element of the refrigerant discharged therethrough. Therefore, the surface level of the lubricating oil and refrigerant accumulated in storage chamber 49 is maintained greater than that in intake side and discharge side cells 33*c* and 35*c* during the operation of the compressor.

With the embodiment described above, since the accumulator is horizontally arranged in parallel with the compressor, the height of the accumulator installed can be reduced, and the accumulator oan be arranged close to the lateral type compressor in a suitable state. Since first and second partition plates 45 and 47 are respectively arranged close to intake port 37 and discharge port 39, a relatively large storage chamber wherein the lubricating oil and the liquid element of the refrigerant are accumulated can be established between partition plates 45 and 47 in container 31. Since small chambers are respectively defined in the opposite end portions in container 31 by respective partition plates 45 and 47, the pressure fluctuation which occurs in response to the compressing and releasing operation of the compressor in storage chamber 49 can be reduced. Furthermore, since a longer gas fluid passage is established between partition plates 45 and 47 compared with the prior art, the gas element can be separated sufficiently from the refrigerant during the migration in storage chamber 49. The gas fluid passage is established along the ceiling of storage chamber 49. Therefore, the mixture of the lubricating oil and the liquid element of the refrigerant accumulated in storage chamber 49 may not be agitated by the gas element of the refrigerant flowing along the gas fluid passage, and thus, a stable liquid separation may be achieved. As shown in FIG. 3, since each partition plate 45, 47 is provided to each receptacle 33*a*, 35*a*, each receptacle 33*a*, 35*a* can be strengthen by each plate 45, 47.

Figure 5:
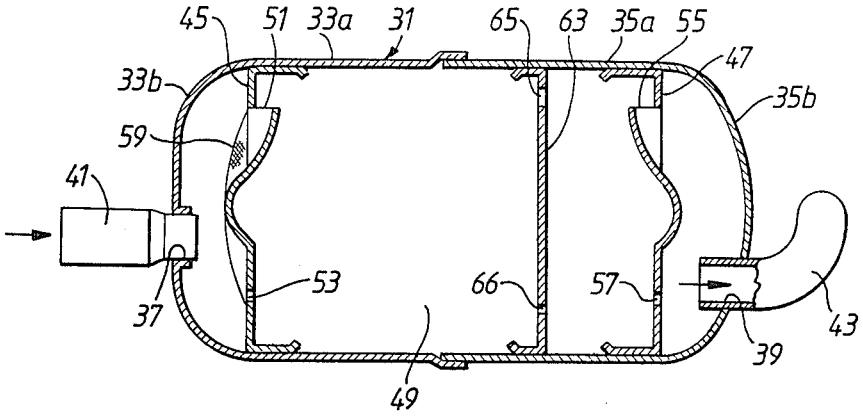
FIG. 5 is a cross sectional view illustrating a second embodiment of the present invention.

A second embodiment of the present invention will be described by reference to FIG. 5. In the second embodiment, a third partition plate 63 is provided in parallel to second partition plate 47 at the center portion of receptacle 35*a*. A gas flow hole 65 is provided in the upper portion of third partition plate 63. Thus, a gas fluid passage is established between first and second partition plates 45 and 47 through gas flow hole 65 of third partition plate 63. An oil return hole 66 is provided at the lower portion of third partition plate 63.

With the second embodiment described above, the pressure fluctuation in storage chamber 49 can be reduced by third partition plate 63. Furthermore, since third partition plate 63 is provided at the center portion of receptacle 35*a*, vibration noises responsive to the pressure fluctuation can also be reduced.

Figure 6:
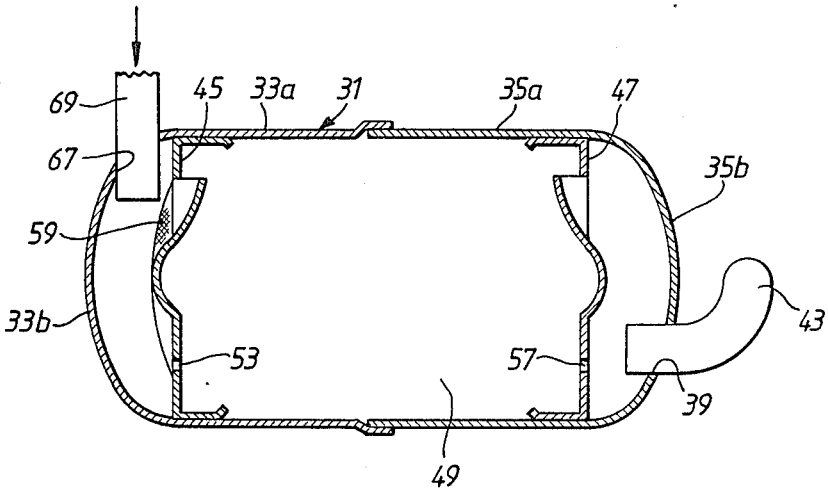
FIG. 6 is a cross sectional view illustrating a third embodiment of the present invention.

A third embodiment of the present invention will now be described by reference to FIG. 6. In this embodiment, an intake port 67 is provided in the upper portion close to bottom 33*b* of receptacle 33*a*. Thus, the end portion of an intake pipe 69 is hermetically inserted into receptacle 33*a* through intake port 67.

With the third embodiment described above, similar effects to the first embodiment can be obtained. As can be understood from the first, second and third embodiments, the position of the intake port may be determined in accordance with environmental circumstances where the accumulator is arranged.

The present invention has been described with respect to specific embodiments. However, other embodiments based on the principles of the present invention should be obvious to those of ordinary skill in the art. Such embodiments are intended to be covered by the claims.

What is claimed is:

1. An accumulator for storing a mixture of a lubricating oil and a refrigerant including a gas element and a liquid element, and for separating the gas element from the mixture in a refrigerating circuit, comprising:

a container for maintaining a reservoier of the lubricating oil and refrigerant for supply to the refrigerating oirouit;

a storage chamber in the container for storing lubricating oil and refrigerant, the lubricating oil and refrigerant in rhe storage chamber having a prescribed surface level, the storage chamber having an upper part;

an intake side cell and a discharge side cell on opposite sides of the storage chamber in the horizontal direction, each including a common wall with the storage chamber for separating the intake side cell and the discharge side cell from the storage chamber, the mixture being drawn from the intake side cell into the storage chamber, the surface level of the lubricating oil and refrigerant in the storage chamber being maintained greater than that in the intake side cell during the operation of tbe refrigerating circuit; and gas fluid passage means at the upper part of the storage chamber for communicating the gas element from the intake side cell to the discharge side cell.

2. An accumulator according to claim 1, wherein the container includes a pair of receptacles, each having an opening, the openings being hermetically coupled with one another.

3. An accumulator according to claim 1, wherein the container includes an intake side wall having an intake opening therein.

4. An accumulator according to claim 3, wherein the container further includes a discharge side wall opposite to the intake side wall, the discharge side wall having a discharge opening therein.

5. An accumulator according to claim 4, wherein the common walls include an intake side partition plate and a discharge side partition plate opposite to the intake side partition plate, each having an upper portion, the storage chamber being defined between the partition plates.

6. An accumulator according to claim 5, wherein the discharge side partition plate includes an oil return means for regulating the amount of the lubricating oil flowing from the storage chamber to the discharge side cell.

7. An accumulator according to claim 6, wherein the storage chamber includes a ceiling, the gas passage means includes an opening at the upper portion of the intake side partition plate, the opening being oriented toward the ceiling.

8. An accumulator according to claim 7, wherein the gas fluid passage means includes a second opening at the upper portion of the discharge side partition plate.

9. An accumulator according to claim 8 further including filter means for filtering the mixture fed from the intake side cell to the storage chamber.

10. An accumulator according to claim 8, wherein the container includes an intake side receptacle and a discharge side receptacle, each having an opening hermetically coupled with one another.

11. An accumulator according to claim 10 further including an inner partition plate parallel to the discharge side plate substantially in the center of the discharge side receptacle.

12. An accumulator according to claim 11, wherein the inner partition plate has an upper portion, the gas fluid passage means including a third opening at the upper portion of the inner partition plate.

13. An accumulator comprising:

a container having an intake side wall and a discharge side wall;

an intake pipe connected for fluid communication with the intake side wall;

a discharge pipe connected for fluid communication with the discharge side wall;

an intake side partition plate perpendicularly disposed adjacent to the intake pipe in the container, the intake side partition plate having an upper portion;

a discharge side partition plate perpendioularly disposed adjacent to the discharge pipe in the container, discharge side partition plate having an upper portion;

a first opening at the upper portion of the intake side partition plate; and a second opening at the upper portion of the discharge side partition plate, the first and second openings establishing a gas fluid passage from the intake pipe to the discharge pipe through the first and second openings.

14. An accumulator in which a gas element is separated from a mixture of a lubricating oil and a refrigerant including the gas element and a liquid element in a refrigerating circuit subject to pressure fluctuation, the accumulator comprising:

a hermetic container having opposite sides in a lateral direction, the hermetic container including, side chamber means for decreasing pressure fluctuation in the container, including an intake side cell at one side of the hermetic container for drawing the mixture in the container, and a discharge side cell at the other side of the hermetic container for discharging the gas element from the container.

a storage chamber disposed between the intake side cell and the discharge side cell for storing the lubricating oil and refrigerant fed from the intake side cell, the storage chamber being larger than the intake side and discharge side cells, the storage chamber having an upper part, and a gas fluid passage at the upper part of the storage chamber for communicating the gas element from the intake side cell to the discharge side cell;

an intake pipe connected into the intake side cell for fluid communication; and a discharge pipe connected into the discharge side cell for fluid communication.

* * * * *